US010021508B2

(12) United States Patent
Kordon et al.

(10) Patent No.: US 10,021,508 B2
(45) **Date of Patent: *Jul. 10, 2018**

(54) METHOD AND APPARATUS FOR PROCESSING SIGNALS OF A SPHERICAL MICROPHONE ARRAY ON A RIGID SPHERE USED FOR GENERATING AN AMBISONICS REPRESENTATION OF THE SOUND FIELD

(71) Applicant: Dolby Laboratories Licensing Corporation, San Francisco, CA (US)

(72) Inventors: Sven Kordon, Wunstorf (DE); Johann-Markus Batke, Hannover (DE); Alexander Krueger, Hannover (DE); Mark R. P. Thomas, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/357,810

(22) Filed: Nov. 21, 2016

(65) Prior Publication Data

US 2017/0070840 A1 Mar. 9, 2017

Related U.S. Application Data

(63) Continuation-in-part of application No. 14/356,185, filed as application No. PCT/EP2012/071535 on Oct. 31, 2012, now Pat. No. 9,503,818.

(30) Foreign Application Priority Data

Nov. 11, 2011 (EP) ..... 11306471

(51) Int. Cl.
*H04R 3/00* (2006.01)
*H04S 7/00* (2006.01)

(52) U.S. Cl.
CPC ..... *H04S 7/307* (2013.01); *H04R 3/005* (2013.01); *H04S 2400/15* (2013.01); *H04S 2420/11* (2013.01)

(58) Field of Classification Search
CPC .. H04S 7/307; H04S 2400/15; H04S 2420/11; H04R 3/005
See application file for complete search history.

(56) References Cited

U.S. PATENT DOCUMENTS 9,503,818 B2 * 11/2016 Kordon ..... H04R 3/005
2003/0016835 A1 1/2003 Elko (Continued)

FOREIGN PATENT DOCUMENTS

EP 1931169 6/2008
WO 2011/116153 10/2010

OTHER PUBLICATIONS

Anonymous, "Eigenmike", mh acoustics, Homepage, online retrieved from: http:www.mhacoustics.com, viewed on: Feb. 1, 2007.

(Continued)

*Primary Examiner* — Andrew L. Sniezek

(57) ABSTRACT

Spherical microphone arrays capture a three-dimensional sound field ($P(\Omega_c, t)$) for generating an Ambisonics representation ($A_n^m(t)$), where the pressure distribution on the surface of the sphere is sampled by the capsules of the array. The impact of the microphones on the captured sound field is removed using the inverse microphone transfer function. The equalization of the transfer function of the microphone array is a big problem because the reciprocal of the transfer function causes high gains for small values in the transfer function and these small values are affected by transducer noise. The invention minimizes that noise by using a Wiener filter processing in the frequency domain, which processing (Continued)

Figure 1:
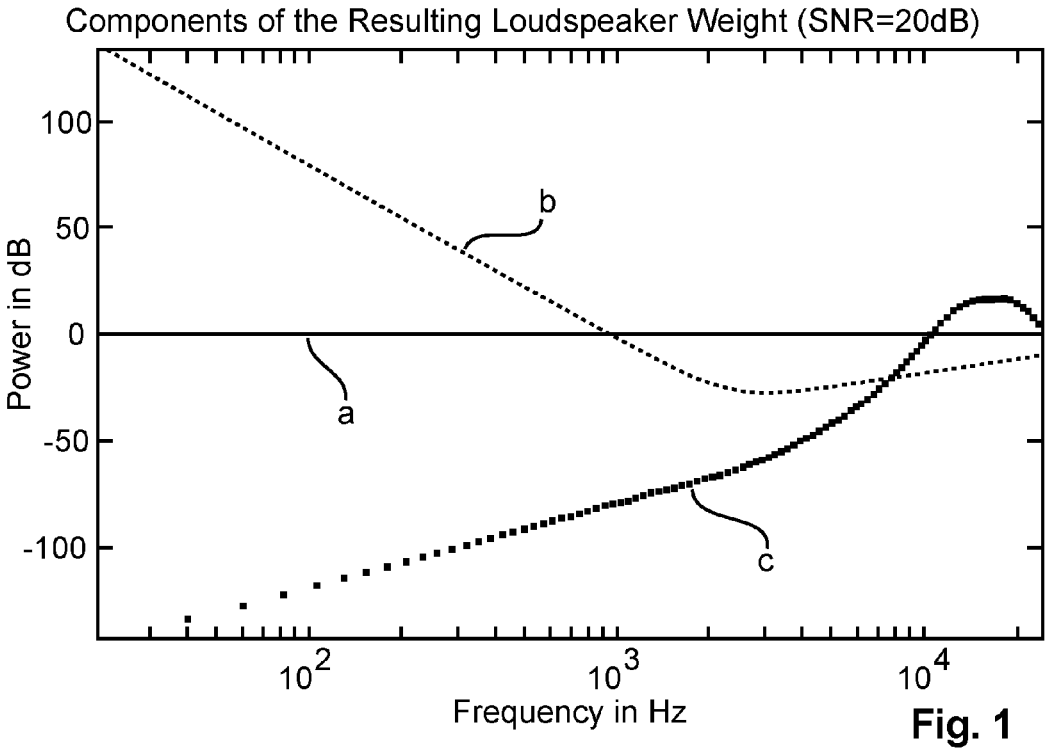

is automatically controlled per wave number by the signal-to-noise ratio of the microphone array.

8 Claims, 2 Drawing Sheets

(56) References Cited

U.S. PATENT DOCUMENTS

| | | | |
|---|---|---|---|
| 2003/0147539 | A1 | 8/2003 | Elko |
| 2004/0247134 | A1 | 12/2004 | Miller |
| 2010/0008517 | A1 | 1/2010 | Elko |
| 2012/0093344 | A1 | 4/2012 | Sun |
| 2014/0270245 | A1 | 9/2014 | Elko |
| 2014/0307894 | A1 | 10/2014 | Kordon |

OTHER PUBLICATIONS

Williams, Earl G. "Fourier Acoustics", Chapter 6, Spherical Waves, Academic Press, Jan. 1, 1999.

Moreau, S. et al "3D Sound Field Recording with Higher Order Ambisonics—Objective Measurements and Validation of Spherical Microphone" AES presented at the 120th convention, May 20-23, 2006, Paris France, pp. 1-24.

Batke, Johann-Markus, et al "Using VBAP-Derived Panning Functions for 3D Ambisonics Decoding" Proc. of the 2nd International Symposium on Ambisonics and Spherical Acoustics, May 6-7, 2010, Paris, France, pp. 1-4.

Rafaely, Boaz "Analysis and Design of Spherical Microphone Arrays" IEEE Transactions on Speech and Audio Processing, vol. 13, No. 1, Jan. 2005, pp. 135-143.

Rafaely, Boaz "Plane-wave Decomposition of the Sound Field on a Sphere by Spherical Convolution" J. Acoust Soc Am, 116 (4),pp. 2149-2157, Oct. 2004.

Fliege, J. et al "A Two-Stage Approach for Computing a Cubature Formulate for the Sphere" Technical report, Fachbereich Mathemarik, Universitat Dortmunt, 1999, Dortmund/Germany, pp. 1-32.

www.mathemarik.unidortmund.de/lsx/research/projects/fliege/nodes/nodes.html; Integration Nodes for the Sphere, Retrieved Oct. 26, 2011.

Agmon, M. et al "Beamforming for a Spherical-Aperture Microphone" IEEE , pp. 227-230, 2008.

Poletti, M.A. "Three-Dimensional Surround Sound Systems Based on Spherical Harmonics" J. Audio Eng. Soc., vol. 53, No. 11, Nov. 2005.

Zotter, Franz "Sampling Strategies for Acoustic Holography/Holophony on the Sphere" Proc. of the NAG-DAGA, 2009, Rotterdam Netherlands.

* cited by examiner

METHOD AND APPARATUS FOR PROCESSING SIGNALS OF A SPHERICAL MICROPHONE ARRAY ON A RIGID SPHERE USED FOR GENERATING AN AMBISONICS REPRESENTATION OF THE SOUND FIELD

The invention relates to a method and to an apparatus for processing signals of a spherical microphone array on a rigid sphere used for generating an Ambisonics representation of the sound field, wherein a correction filter is applied to the inverse microphone array response.

BACKGROUND

Spherical microphone arrays offer the ability to capture a three-dimensional sound field. One way to store and process the sound field is the Ambisonics representation. Ambisonics uses orthonormal spherical functions for describing the sound field in the area around the point of origin, also known as the sweet spot. The accuracy of that description is determined by the Ambisonics order N, where a finite number of Ambisonics coefficients describes the sound field. The maximal Ambisonics order of a spherical array is limited by the number of microphone capsules, which number must be equal to or greater than the number $O=(N+1)^2$ of Ambisonics coefficients.

One advantage of the Ambisonics representation is that the reproduction of the sound field can be adapted individually to any given loudspeaker arrangement. Furthermore, this representation enables the simulation of different microphone characteristics using beam forming techniques at the post production.

The B-format is one known example of Ambisonics. A B-format microphone requires four capsules on a tetrahedron to capture the sound field with an Ambisonics order of one.

Ambisonics of an order greater than one is called Higher Order Ambisonics (HOA), and HOA microphones are typically spherical microphone arrays on a rigid sphere, for example the Eigenmike of mhAcoustics. For the Ambisonics processing the pressure distribution on the surface of the sphere is sampled by the capsules of the array. The sampled pressure is then converted to the Ambisonics representation. Such Ambisonics representation describes the sound field, but including the impact of the microphone array. The impact of the microphones on the captured sound field is removed using the inverse microphone array response, which transforms the sound field of a plane wave to the pressure measured at the microphone capsules. It simulates the directivity of the capsules and the interference of the microphone array with the sound field.

The equalisation of the transfer function of the microphone array is a big problem for HOA recordings. If the Ambisonics representation of the array response is known, the impact can be removed by the multiplication of the Ambisonics representation with the inverse array response. However, using the reciprocal of the transfer function can cause high gains for small values and zeros in the transfer function. Therefore, the microphone array should be designed in view of a robust inverse transfer function. For example, a B-format microphone uses cardioid capsules to overcome the zeros in the transfer function of omni-directional capsules.

Invention

The invention is related to spherical microphone arrays on a rigid sphere. The shading effect of the rigid sphere enables a good directivity for frequencies with a small wavelength with respect to the diameter of the array. On the other hand, the filter responses of these microphone arrays have very small values for low frequencies and high Ambisonics orders (i.e. greater than one). The Ambisonics representation of the captured pressure has therefore small higher order coefficients, which represent the small pressure difference at the capsules for wave lengths that are long when compared to the size of the array. The pressure differences, and therefore also the higher order coefficients, are affected by the transducer noise. Thus, for low frequencies the inverse filter response amplifies mainly the noise instead of the higher order Ambisonics coefficients.

A known technique for overcoming this problem is to fade out (or high pass filter) the high orders for low frequencies (i.e. to limit there the filter gain), which on one hand decreases the spatial resolution for low frequencies but on the other hand removes (highly distorted) HOA coefficients, thereby corrupting the complete Ambisonics representation. A corresponding compensation filter design that tries to solve this problem using Tikhonov regularisation filters is described in Sébastien Moreau, Jérôme Daniel, Stéphanie Bertet, "3D Sound field Recording with Higher Order Ambisonics—Objective Measurements and Validation of a 4th Order Spherical Microphone", Audio Engineering Society convention paper, 120th Convention 20-23 May 2006, Paris, France, in section 4. A Tikhonov regularisation filter minimises the squared error resulting from the limitation of the Ambisonics order. However, the Tikhonov filter requires a regularisation parameter that has to be adapted manually to the characteristics of the recorded signal by 'trial and error', and there is no analytic expression defining this parameter.

Based on the analysis of spherical microphone arrays of Boaz Rafaely, "Analysis and Design of Spherical Microphone Arrays", IEEE Transactions on Speech and Audio Processing, vol. 13, no. 1, pages 135-143, 2005, the invention shows how to obtain automatically the regularisation parameter from the signal statistics of the microphone signals.

A problem to be solved by the invention is to minimise noise, in particular low frequency noise, in an Ambisonics representation of the signals of a spherical microphone array arranged on a rigid sphere. This problem is solved by the method disclosed in claim 1. An apparatus that utilises this method is disclosed in claim 2.

The inventive processing is used for computing the regularisation Tikhonov parameter in dependence of the signal-to-noise ratio of the average sound field power and the noise power of the microphone capsules, i.e. that optimisation parameter is computed from the signal-to-noise ratio of the recorded microphone array signals. The computation of the optimisation or regularisation parameter includes the following steps:

- Converting the microphone capsule signals $P(\Omega_c, t)$ representing the pressure on the surface of said microphone array to a spherical harmonics (or the equivalent Ambisonics) representation $A_n^m(t)$;
- Computing per wave number k an estimation of the time-variant signal-to-noise ratio SNR(k) of the microphone capsule signals $P(\Omega_c, t)$, using the average source power $|P_0(k)|^2$ of the plane wave recorded from the microphone array and the corresponding noise power $|P_{noise}(k)|^2$ representing the spatially uncorrected noise produced by analog processing in the microphone array, i.e. including computing the average spatial power by computing separately a reference signal and a noise signal, wherein the reference signal is the representation of the sound field that can be created with the used microphone array, and the noise signal is the spatially uncorrelated noise produced by the analog processing of the microphone array.

By using a time-variant Wiener filter for each order n designed at discrete finite wave numbers k from the signal-to-noise ratio estimation SNR(k), multiplying the transfer function of the Wiener filter by the inverse transfer function $$\frac{1}{b_n(kR)}$$

of the microphone array in order to get an adapted transfer function $F_{n,array}(k)$;

Applying that adapted transfer function $F_{n,array}(k)$ to the spherical harmonics representation $A_n^m(t)$ using a linear filter processing, resulting in adapted directional coefficients $d_n^m(t)$.

The filter design requires an estimation of the average power of the sound field in order to obtain the SNR of the recording. The estimation is derived from the simulation of the average signal power at the capsules of the array in the spherical harmonics representation. This estimation includes the computation of the spatial coherence of the capsule signal in the spherical harmonics representation. It is known to compute the spatial coherence from the continuous representation of a plane wave, but according to the invention the spatial coherence is computed for a spherical array on a rigid sphere, because the sound field of a plane wave on the rigid sphere cannot be computed in the continuous representation, i.e., according to the invention the SNR is estimated from the capsule signals.

The invention includes the following advantages:

The order of the Ambisonics representation is optimally adapted to the SNR of the recording for each frequency sub-band. This reduces the audible noise at the reproduction of the Ambisonics representation.

The estimation of the SNR is required for the filter design. It can be implemented with a low computational complexity by using look-up tables. This facilitates a time-variant adaptive filter design with manageable computational effort.

By the noise reduction, the directional information is partly restored for low frequencies.

In principle, the inventive method is suited for processing microphone capsule signals of a spherical microphone array on a rigid sphere, said method including the steps:

converting said microphone capsule signals $P(\Omega_c, t)$ representing the pressure on the surface of said microphone array to a spherical harmonics or Ambisonics representation $A_n^m(t)$;

computing per wave number k an estimation of the time-variant signal-to-noise ratio SNR(k) of said microphone capsule signals $P(\Omega_c, t)$, using the average source power $|P_0(k)|^2$ of the plane wave recorded from said microphone array and the corresponding noise power $|P_{noise}(k)|^2$ representing the spatially uncorrected noise produced by analog processing in said microphone array;

by using a time-variant Wiener filter for each order n designed at discrete finite wave numbers k from said signal-to-noise ratio estimation SNR(k), multiplying the transfer function of said Wiener filter by the inverse transfer function of said microphone array in order to get an adapted transfer function $F_{n,array}(k)$;

applying said adapted transfer function $F_{n,array}(k)$ to said spherical harmonics representation $A_n^m(t)$ using a linear filter processing, resulting in adapted directional coefficients $d_n^m(t)$.

In principle the inventive apparatus is suited for processing microphone capsule signals of a spherical microphone array on a rigid sphere, said apparatus including:

means being adapted for converting said microphone capsule signals $P(\Omega_c, t)$ representing the pressure on the surface of said microphone array to a spherical harmonics or Ambisonics representation $A_n^m(t)$;

means being adapted for computing per wave number k an estimation of the time-variant signal-to-noise ratio SNR(k) of said microphone capsule signals $P(\Omega_c, t)$, using the average source power $|P_0(k)|^2$ of the plane wave recorded from said microphone array and the corresponding noise power $|P_{noise}(k)|^2$ representing the spatially uncorrected noise produced by analog processing in said microphone array;

means being adapted for multiplying, by using a time-variant Wiener filter for each order n designed at discrete finite wave numbers k from said signal-to-noise ratio estimation SNR(k), the transfer function of said Wiener filter by the inverse transfer function of said microphone array in order to get an adapted transfer function $F_{n,array}(k)$;

means being adapted for applying said adapted transfer function $F_{n,array}(k)$ to said spherical harmonics representation $A_n^m(t)$ using a linear filter processing, resulting in adapted directional coefficients $d_n^m(t)$.

Advantageous additional embodiments of the invention are disclosed in the respective dependent claims.

DRAWINGS

Figure 2:
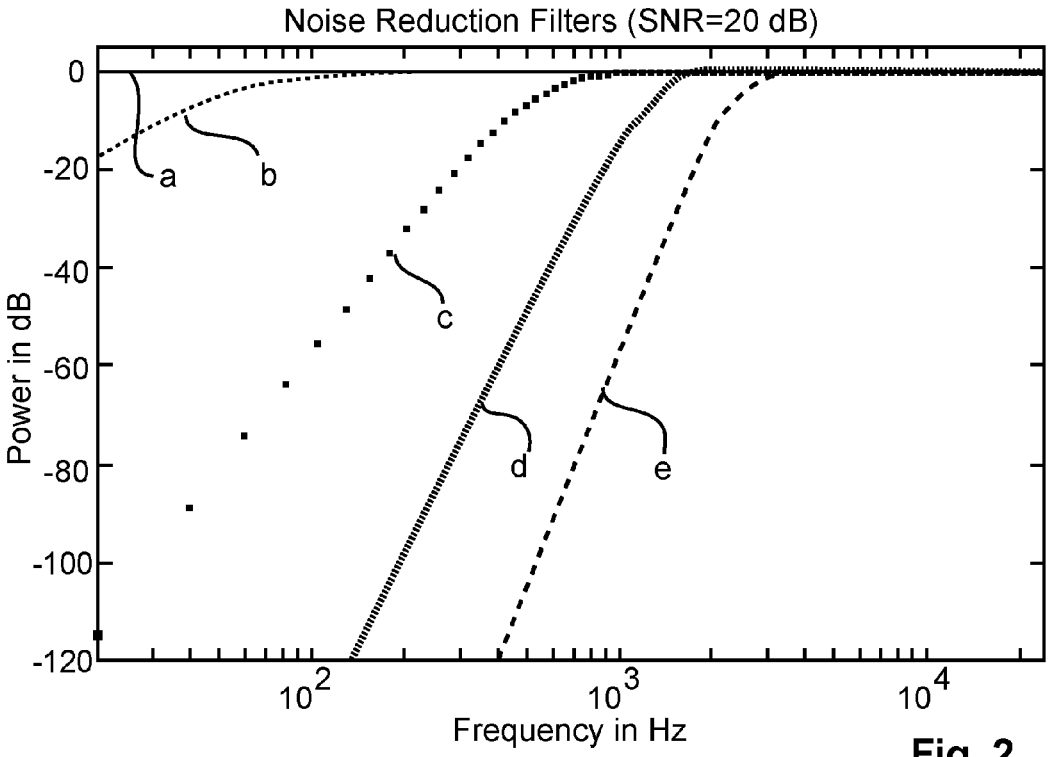
Figure 3:
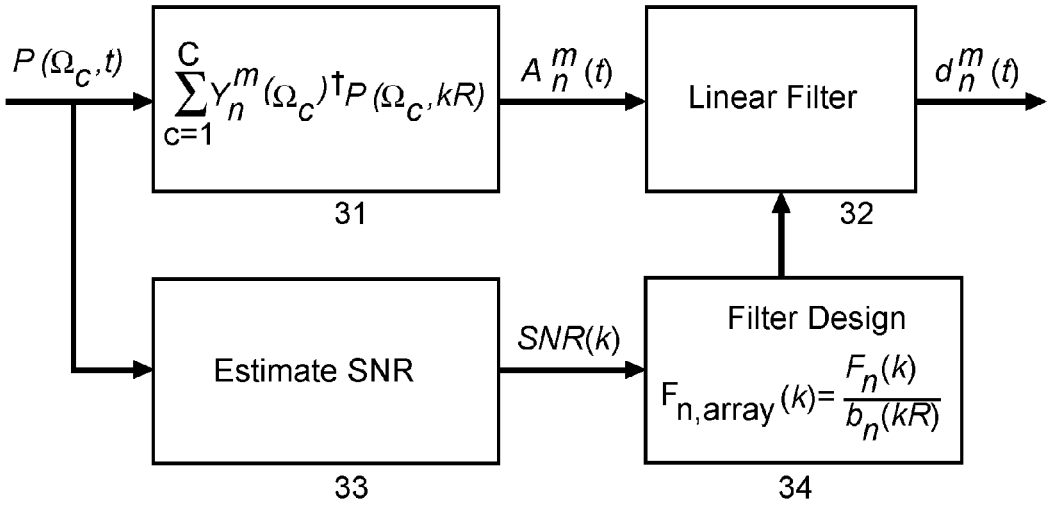
Figure 4:
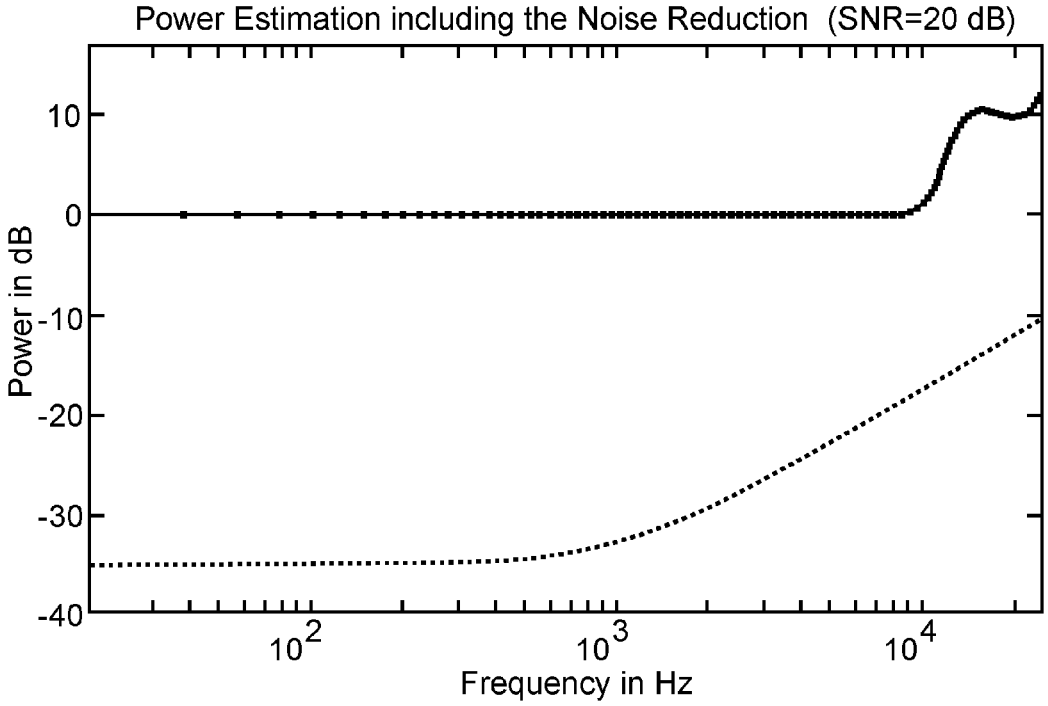

Exemplary embodiments of the invention are described with reference to the accompanying drawings, which show in:

FIG. 1 power of reference, aliasing and noise components from the resulting loudspeaker weight for a microphone array with 32 capsules on a rigid sphere;

FIG. 2 noise reduction filter for SNR(k)=20 dB;

FIG. 3 block diagram for a block-based adaptive Ambisonics processing;

FIG. 4 average power of weight components following the optimisation filter of FIG. 2.

EXEMPLARY EMBODIMENTS

In the following section the spherical microphone array processing is described.

Ambisonics Theory

Ambisonics decoding is defined by assuming loudspeakers that are radiating the sound field of a plane wave, cf. M. A. Poletti, "Three-Dimensional Surround Sound Systems Based on Spherical Harmonics", Journal Audio Engineering Society, vol. 53, no. 11, pages 1004-1025, 2005:

$$w(\Omega_l k)=\Sigma_{n=0}^{N}\Sigma_{m=-n}^{n}D_n^m(\Omega_l)d_n^m(k) \quad (1)$$

The arrangement of L loudspeakers reconstructs the three-dimensional sound field stored in the Ambisonics coefficients $d_n^m(k)$. The processing is carried out separately for each wave number $$= \frac{2\pi f}{c_{sound}}, \quad (2)$$

where f is the frequency and $c_{sound}$ is the speed of sound. Index n runs from 0 to the finite order N, whereas index m runs from −n to n for each index n. The total number of coefficients is therefore $O=(N+1)^2$. The loudspeaker position is defined by the direction vector $\Omega_l=[\Theta_l, \Phi_l]^T$ in spherical coordinates, and $[\bullet]^T$ denotes the transposed version of a vector.

Equation (1) defines the conversion of the Ambisonics coefficients $d_n^m(k)$ to the loudspeaker weights $w(\Omega_l, k)$. These weights are the driving functions of the loudspeakers. The superposition of all speaker weights reconstructs the sound field.

The decoding coefficients $D_n^m(\Omega_l)$ are describing the general Ambisonics decoding processing. This includes the conjugated complex coefficients of a beam pattern as shown in section 3 ($\omega^*_{nm}$) in Morag Agmon, Boaz Rafaely, "Beamforming for a Spherical-Aperture Microphone", IEEEI, pages 227-230, 2008, as well as the rows of the mode matching decoding matrix given in the above-mentioned M. A. Poletti article in section 3.2. A different way of processing, described in section 4 in Johann-Markus Batke, Florian Keiler, "Using VBAP-Derived Panning Functions for 3D Ambisonics Decoding", Proc. of the 2nd International Symposium on Ambisonics and Spherical Acoustics, 6-7 May 2010, Paris, France, uses vector based amplitude panning for computing a decoding matrix for an arbitrary three-dimensional loudspeaker arrangement. The row elements of these matrices are also described by the coefficients $D_n^m(\Omega_l)$.

The Ambisonics coefficients $d_n^m(k)$ can always be decomposed into a superposition of plane waves, as described in section 3 in Boaz Rafaely, "Plane-wave decomposition of the sound field on a sphere by spherical convolution", J. Acoustical Society of America, vol. 116, no. 4, pages 2149-2157, 2004. Therefore the analysis can be limited to the coefficients of a plane wave impinging from a direction $\Omega_s$:

$$d_{n_{plane}}^m(k)=P_0(k)Y_n^m(\Omega_s)^* \tag{3}$$

The coefficients of a plane wave $d_{n_{plane}}^m(k)$ are defined for the assumption of loudspeakers that are radiating the sound field of a plane wave. The pressure at the point of origin is defined by $P_0(k)$ for the wave number k. The conjugated complex spherical harmonics $Y_n^m(\Omega_s)^*$ denote the directional coefficients of a plane wave. The definition of the spherical harmonics $Y_n^m(\Omega_s)$ given in the above-mentioned M. A. Po-letti article is used.

The spherical harmonics are the orthonormal base functions of the Ambisonics representations and satisfy $$\delta_{n-n'}\delta_{m-m'} = \int_{\Omega\in S^2} Y_n^m(\Omega)Y_{n'}^{m'}(\Omega)^* d\Omega, \tag{4}$$

$$\text{where } \delta_q = \begin{cases} 1, & \text{for } q=0 \\ 0, & \text{else} \end{cases} \text{ is the delta impulse.} \tag{5}$$

A spherical microphone array samples the pressure on the surface of the sphere, wherein the number of sampling points must be equal to or greater than the number $O=(N+1)^2$ of Ambisonics coefficients. For an Ambisonics order of N. Furthermore, the sampling points have to be uniformly distributed over the surface of the sphere, where an optimal distribution of O points is exactly known only for order N=1. For higher orders good approximations of the sampling of the sphere are existing, cf. the mh acoustics homepage http://www.rnhacoustics.com, visited on 1 Feb. 2007, and F. Zotter, "Sampling Strategies for Acoustic Holography/Holophony on the Sphere", Proceedings of the NAG-DAGA, 23-26 Mar. 2009, Rotterdam.

For optimal sampling points $\Omega_c$, the integral from equation (4) is equivalent to the discrete quadrature sum from equation (6):

$$\delta_{n-n'}\delta_{m-m'} = \frac{4\pi}{C}\sum_{c=1}^{C} w_c Y_n^m(\Omega_c)Y_{n'}^{m'}(\Omega_c)^*, \tag{6}$$

with $n'\leq N$ and $n\leq N$ for $C\geq(N+1)^2$, C being the total number of capsules, and $w_c$ being a set of weights to enable orthonormality of the sampled spherical harmonics.

In order to achieve stable results for non-optimum sampling points, the conjugated complex spherical harmonics can be replaced by the columns of the pseudo-inverse matrix $\underline{Y}^\dagger$, which is obtained from the L×O spherical harmonics matrix $\underline{Y}$, where the O coefficients of the spherical harmonics $Y_n^m(\Omega_c)$ are the row-elements of $\underline{Y}$, cf. section 3.2.2 in the above-mentioned Moreau/Daniel/Bertet article:

$$Y^\dagger=(Y^H WY)^{-1}Y^H W$$

Where W is an additional weighting matrix to account for the non-uniformity of the microphone distribution.

In the following it is defined that the column elements of $\underline{Y}^\dagger$ are denoted $Y_n^m(\Omega_c)^{554}$, so that the orthonormal condition from equation (6) is also satisfied for $$\delta_{n-n}\delta_{m-m'}=\Sigma_{c=1}^{c}Y_n^m(\Omega_c)Y_{n'}^{m'}(\Omega_c)^\dagger \tag{8}$$

with $n'\leq N$ and $n\leq N$ for $C\geq(N+1)^2$.

If it is assumed that the spherical microphone array has nearly uniformly distributed capsules on the surface of a sphere so that $w_c=1\ \forall c$ and that the number of capsules is greater than O, then $$Y_n^m(\Omega_c)^\dagger \approx \frac{4\pi}{C}Y_n^m(\Omega_c)^* \tag{9}$$

becomes a valid expression. The substitution of (9) in (8) results in the orthonormal condition $$\frac{4\pi}{C}\delta_{n-n'}\delta_{m-m'} = \sum_{c=1}^{C} Y_n^m(\Omega_c)^\dagger Y_{n'}^{m'}(\Omega_c)^{\dagger *}, \tag{10}$$

with $n'\leq N$ and $n\leq N$ for $C\geq(N+1)^2$, which is to be considered below.

Alternatively if $c=(N-1)^2$, a hyperinterpolation scheme may be employed instead of quadrature or least squares. The nodes form a well-conditioned matrix Y such that $$\delta_{n-n'}\delta_{m-m'} = \sum_{c=1}^{C} Y_n^m(\Omega_c)Y_{n'}^{m'}(\Omega_c)^{-1}$$

where $Y_{n'}^{m'}(\Omega_c)^{-1}$ are the columns of $Y^{-1}$.

The advantage of this scheme is the exact reproduction of the function at the sample points without approximation error. Further details on hyperinterpolation schemes can be found in R. S. Womersley and I. H. Sloan, "How good can polynomial interpolation on the sphere be" Sydney Tech. Rep., April 2001.

Simulation of the Processing

A complete HOA processing chain for spherical microphone arrays on a rigid (stiff, fixed) sphere includes the estimation of the pressure at the capsules, the computation of the HOA coefficients and the decoding to the loudspeaker weights. It is based on that for a plane wave the reconstructed weight w(k) from the microphone array must be equal to the reconstructed reference weight $w_{ref}(k)$ from the coefficients of a plane wave, given in equation (3).

The following section presents the decomposition of w(k) into the reference weight $w_{ref}(k)$, the spatial aliasing weight $w_{alias}(k)$ and a noise weight $w_{noise}(k)$. The aliasing is caused by the sampling of the continuous sound field for a finite order N and the noise simulates the spatially uncorrelated signal parts introduced for each capsule. The spatial aliasing cannot be removed for a given microphone array.

Simulation of Capsule Signals

The transfer function of an impinging plane wave for a microphone array on the surface of a rigid sphere is defined in section 2.2, equation (19) of the above-mentioned M. A. Po-letti article:

$$b_n(kR) = \frac{4\pi i^{n+1}}{(kR)^2 \left.\frac{dh_n^{(1)}(kr)}{dkr}\right|_{kr=kR}}, \tag{11}$$

where $h_n^{(1)}(kr)$ is the Hankel function of the first kind and the radius r is equal to the radius of the sphere R. The transfer function is derived from the physical principle of scattering the pressure on a rigid sphere, which means that the radial velocity vanishes on the surface of a rigid sphere. In other words, the superposition of the radial derivation of the incoming and the scattered sound field is zero, cf. section 6.10.3 of the "Fourier Acoustics" book.

Thus, the pressure on the surface of the sphere at the position Ω for a plane wave impinging from $\Omega_s$ is given in section 3.2.1, equation (21) of the Moreau/Daniel/Bertet article by $$P(\Omega,kR)=\Sigma_{n=0}^{\infty}\Sigma_{m=-n}^{n} b_n(kR)Y_n^m(\Omega)d_n^m(k)= \Sigma_{n=0}^{\infty}\Sigma_{m=-n}^{n} b_n(kR)Y_n^m(\Omega)Y_n^m(\Omega_s)^*P_0(k). \tag{12}$$

The isotropic noise signal $P_{noise}(\Omega_c, k)$ is added to simulate transducer noise, where 'isotropic' means that the noise signals of the capsules are spatially uncorrelated, which does not include the correlation in the temporal domain.

The pressure can be separated into the pressure $P_{ref}(\Omega_c, kR)$ computed for the maximal order N of the microphone array and the pressure from the remaining orders, cf. section 7, equation (24) in the above-mentioned Rafaely "Analysis and design . . . " article. The pressure from the remaining orders $P_{alias}(\Omega_c, kR)$ is called the spatial aliasing pressure because the order of the microphone array is not sufficient to reconstruct these signal components. Thus, the total pressure recorded at the capsule c is defined by:

$$P(\Omega_c, kR) = P_{ref}(\Omega_c, kR) + P_{alias}(\Omega_c, kR) + P_{noise}(\Omega_c, k) \tag{13a}$$

$$= \sum_{n=0}^{N}\sum_{m=-n}^{n} b_n(kR)Y_n^m(\Omega_c)Y_n^m(\Omega_s)^*P_0(k) + \tag{13b}$$

$$\sum_{n=N+1}^{\infty}\sum_{m=-n}^{n} b_n(kR)Y_n^m(\Omega_c)Y_n^m(\Omega_s)^*P_0(k) + P_{noise}(\Omega_c, k).$$

Ambisonics Encoding

The Ambisonics coefficients $d_n^m(k)$ are obtained from the pressure at the capsules by the inversion of equation (12) given in equation (14a), cf. section 3.2.2, equation (26) of the above-mentioned Moreau/Daniel/Bertet article. The spherical harmonics $Y_n^m(\Omega_c)$ is inverted by $Y_n^m(\Omega_c)^\dagger$ using equation (8), and the transfer function $b_n(kR)$ is equalised by its inverse:

$$d_n^m(k) = \sum_{c=1}^{C} \frac{Y_n^m(\Omega_c)^\dagger P(\Omega_c, kR)}{b_n(kR)} \tag{14a}$$

$$= \sum_{c=1}^{C} \frac{Y_n^m(\Omega_c)^\dagger (P_{ref}(\Omega_c, kR) + P_{alias}(\Omega_c, kR) + P_{noise}(\Omega_c, k))}{b_n(kR)} \tag{14b}$$

$$= d_{n_{ref}}^m(k) + d_{n_{alias}}^m(k) + d_{n_{noise}}^m(k). \tag{14c}$$

The Ambisonics coefficients $d_n^m(k)$ can be separated into the reference coefficients $d_{n_{ref}}^m(k)$, the aliasing coefficients $d_{n_{alias}}^m(k)$ and the noise coefficients $d_{n_{noise}}^m(k)$ using equations (14a) and (13a) as shown in equations (14b) and (14c).

Ambisonics Decoding

The optimisation uses the resulting loudspeaker weight w(k) at the point of origin. It is assumed that all speakers have the same distance to the point of origin, so that the sum over all loudspeaker weights results in w(k). Equation (15) provides w(k) from equations (1) and (14b), where L is the number of loudspeakers:

$$w(k) = \sum_{l=1}^{L} \sum_{n=0}^{N} \sum_{m=-n}^{n} D_n^m(\Omega_l) \times \sum_{c=1}^{C} \frac{Y_n^m(\Omega_c)^\dagger (P_{ref}(\Omega_c, kR) + P_{alias}(\Omega_c, kR) + P_{noise}(\Omega_c, k))}{b_n(kR)} = w_{ref}(k) + w_{alias}(k) + w_{noise}(k). \quad (15b)$$

Equation (15b) shows that w(k) can also be separated into the three weights $w_{ref}(k)$, $w_{alias}(k)$ and $w_{noise}(k)$. For simplicity, the positioning error given in section 7, equation (24) of the above-mentioned Rafaely "Analysis and design . . . " article is not considered here.

In the decoding, the reference coefficients are the weights that a synthetically generated plane wave of order n would create. In the following equation (16a) the reference pressure $P_{ref}(\Omega_c, kR)$ from equation (13b) is substituted in equation (15a), whereby the pressure signals $P_{alias}(\Omega_c, kR)$ and $P_{noise}(\Omega_c, k)$ are ignored (i.e. set to zero):

$$w_{ref}(k) = \sum_{l=1}^{L} \sum_{n=0}^{N} \sum_{m=-n}^{n} D_n^m(\Omega_l) \times \sum_{n'=0}^{N} \sum_{m'=-n'}^{n'} Y_{n'}^{m'}(\Omega_s)^* \frac{b_{n'}(kR)}{b_n(kR)} \sum_{c=1}^{C} Y_n^m(\Omega_c)^\dagger Y_{n'}^{m'}(\Omega_c) P_0(k) \quad (16a)$$

$$= \sum_{l=1}^{L} \sum_{n=0}^{N} \sum_{m=-n}^{n} D_n^m(\Omega_l) Y_n^m(\Omega_s)^* P_0(k) = \sum_{l=1}^{L} \sum_{n=0}^{N} \sum_{m=-n}^{n} D_n^m(\Omega_l) d_{n_{plane}}^m(k) \quad (16b)$$

The sums over c, n' and m' can be eliminated using equation (8), so that equation (16a) can be simplified to the sum of the weights of a plane wave in the Ambisonics representation from equation (3). Thus, if the aliasing and noise signals are ignored, the theoretical coefficients of a plane wave of order N can be perfectly reconstructed from the microphone array recording.

The resulting weight of the noise signal $w_{noise}(k)$ is given by $$w_{noise}(k) = \sum_{l=1}^{L} \sum_{n=0}^{N} \sum_{m=-n}^{n} D_n^m(\Omega_l) \times \sum_{c=1}^{C} \frac{Y_n^m(\Omega_c)^\dagger P_{noise}(\Omega_c, k)}{b_N(kR)} \quad (17)$$

from equation (15a) and using only $P_{noise}(\Omega_c, k)$ from equation (13b).

Substituting the term of $P_{alias}(\Omega_c, kR)$ from equation (13b) in equation (15a) and ignoring the other pressure signals results in:

$$w_{alias}(k) = \sum_{l=1}^{L} \sum_{n=0}^{N} \sum_{m=-n}^{n} D_n^m(\Omega_l) \times \sum_{n'=N+1}^{\infty} \sum_{m'=-n'}^{n'} Y_{n'}^{m'}(\Omega_s)^* \frac{b_{n'}(kR)}{b_n(kR)} \sum_{c=1}^{C} Y_n^m(\Omega_c)^\dagger Y_{n'}^{m'}(\Omega_c) P_0(k). \quad (18)$$

The resulting aliasing weight $w_{alias}(k)$ cannot be simplified by the orthonormal condition from equation (8) because the index n' is greater than N.

The simulation of the alias weight requires an Ambisonics order that represents the capsule signals with a sufficient accuracy. In section 2.2.2, equation (14) of the above-mentioned Moreau/Daniel/Bertet article an analysis of the truncation error for the Ambisonics sound field reconstruction is given. It is stated that for $$N_{opt} = \lceil kR \rceil \quad (19)$$

a reasonable accuracy of the sound field can be obtained, where '⌈•⌉' denotes the rounding-up to the nearest integer. This accuracy is used for the upper frequency limit $f_{max}$ of the simulation. Thus, the Ambisonics order of $$N_{max} = \left\lceil \frac{2\pi f_{max} R}{c_{sound}} \right\rceil \quad (20)$$

is used for the simulation of the aliasing pressure of each wave number. This results in an acceptable accuracy at the upper frequency limit, and the accuracy even increases for low frequencies.

Analysis of the Loudspeaker Weight

FIG. 1 shows the power of the weight components a) $w_{ref}(k)$, b) $w_{noise}(k)$ and c) $w_{alias}(k)$ from the resulting loudspeaker weight for a plain wave from direction $\Omega_s=[0, 0]^T$ for a microphone array with 32 capsules on a rigid sphere (the Eigenmike from the above-mentioned Agmon/Rafaely article has been used for the simulation). The microphone capsules are uniformly distributed on the surface of the sphere with R=4.2 cm so that the orthonormal conditions are fulfilled. The maximal Ambisonics order N supported by this array is four. The mode matching processing as described in the above-mentioned M. A. Poletti article is used to obtain the decoding coefficients $D_n^m(\Omega_l)$ for 25 uniformly distributed loudspeaker positions according to Jorg Fliege, Ulrike Maier, "A Two-Stage Approach for Computing Cubature Formulae for the Sphere", Technical report, 1996, Fachbereich Mathematik, Universitat Dortmund, Germany. The node numbers are shown at http://www.mathematik.uni-dortmund.de/lsx/research/projects/fliege/nodes/nodes.html.

The reference power $w_{ref}(k)$ is constant over the entire frequency range. The resulting noise weight $w_{noise}(k)$ shows high power at low frequencies and decreases at higher frequencies. The noise signal or power is simulated by a normally distributed unbiased pseudo-random noise with a variance of 20 dB (i.e. 20 dB lower than the power of the plane wave). The aliasing noise $w_{alias}(k)$ can be ignored at low frequencies but increases with rising frequency, and above 10 kHz exceeds the reference power. The slope of the aliasing power curve depends on the plane wave direction. However, the average tendency is consistent for all directions.

The two error signals $w_{noise}(k)$ and $w_{alias}(k)$ distort the reference weight in different frequency ranges. Furthermore, the error signals are independent of each other. Therefore it is proposed to minimise the noise signal without taking into account the alias signal.

The mean square error between the reference weight and the distorted reference weight is minimised for all incoming plane wave directions. The weight from the aliasing signal $w_{alias}(k)$ is ignored because $w_{alias}(k)$ cannot be corrected after being spatially band-limited by the order of the Ambisonics representation. This is equivalent to the time domain aliasing where the aliasing cannot be removed from the sampled and band-limited time signal.

Optimisation—Noise Reduction

The noise reduction minimises the mean squared error introduced by the noise signal. The Wiener filter processing is used in the frequency domain for computing the frequency response of the compensation filter for each order n. The error signal is obtained from the reference weight $w_{ref}(k)$ and the filtered and distorted weight $w_{ref}(k)+w_{noise}(k)$ for each wave number k. As mentioned before, the aliasing error $w_{alias}(k)$ is ignored here. The distorted weight is filtered by the optimisation transfer function F(k), where the processing is performed in the frequency domain by a multiplication of the distorted signal and the transfer function F(k). The zero phase transfer function F(k) is derived by minimising the expectation value of the squared error between the reference weight and the filtered and distorted weight:

$$E\{|w_{ref}(k) - F(k)(w_{ref}(k) + w_{noise}(k))|^2\} == E\{|w_{ref}(k)|^2\} - \tag{21a}$$

$$2F(k)E\{|w_{ref}(k)|^2\} + F(k)^2(E\{|w_{ref}(k)|^2\} + E\{|w_{noise}(k)|^2\}) \tag{21b}$$

The solution, which is well-known as the Wiener filter, is then given by $$(k) = \frac{1}{1 + \frac{E\{|w_{noise}(k)|^2\}}{E\{|w_{ref}(k)|^2\}}}. \tag{23}$$

The expectation value E of the squared absolute weight denotes the average signal power of the weight. Therefore the fraction of the powers of $w_{noise}(k)$ and $w_{ref}(k)$ represents the reciprocal signal-to-noise ration of the reconstructed weights for each wave number k. The computation of the power of $w_{noise}(k)$ and $w_{ref}(k)$ is explained in the following section.

The power of the reference weight $w_{ref}(k)$ is obtained from equation (16) according to section Appendix, equation (34) of the above-mentioned Rafaely "Analysis and design . . . " article:

$$E\{|w_{ref}(k)|^2\} = \frac{1}{4\pi}\int_{\Omega_s\in S^2}\left|\sum_{n=0}^{N}\sum_{m=-n}^{n}\sum_{l=1}^{L} D_n^m(\Omega_l)Y_n^m(\Omega_s)^* P_0(k)\right|^2 d\Omega_s$$

$$= \frac{1}{4\pi}\sum_{n=0}^{N}\sum_{m=-n}^{n}\sum_{m'=-n'}^{n'}\sum_{l=1}^{L}\sum_{l'=1}^{L'} D_n^m(\Omega_l)D_{n'}^{m'}(\Omega_{l'})^*|P_0(k)|^2 \times \int_{\Omega_s\in S^2} Y_n^m(\Omega_s)^* Y_{n'}^{m'}(\Omega_s)d\Omega_s \tag{24b}$$

$$= \frac{|P_0(k)|^2}{4\pi}\sum_{n=0}^{N}\sum_{m=-n}^{n}\left|\sum_{l=1}^{L} D_n^m(\Omega_l)\right|^2 \tag{24c}$$

$$= \sum_{n=0}^{N} E_n\{|w_{ref}(k)|^2\}. \tag{24d}$$

Equation (24c) shows that the power is equal to the sum of the squared absolute HOA coefficients $D_n^m(\Omega_l)$ added up over all loudspeakers. It is assumed that $|P_0(k)|^2$ is the average sound field energy and $P_0(k)$ is constant for all $\Omega_s$. This means that the power of $w_{ref}(k)$ can be separated into the sum of the power of each order n. If this is also true for the expectation value of $w_{noise}(k)$, the error signal can be minimised from equation (21) separately for each order n in order to obtain the global minimum.

The derivation of the power of $w_{noise}(k)$ is given in section 7, equation (28) of the above-mentioned Rafaely "Analysis and design . . . " article. Because the noise signals are spatially uncorrected, the expectation value can be computed independently for each capsule. The expected power of the noise weight is derived from equation (17) by:

$$E\{|w_{noise}(k)|^2\} = \frac{1}{4\pi}\int_{\Omega_s\in S^2}\sum_{c=1}^{C}\left|\sum_{l=1}^{L}\sum_{n=0}^{N}\sum_{m=-n}^{n} D_n^m(\Omega_l)\frac{Y_n^m(\Omega_c)^\dagger P_{noise}(\Omega_c, k)}{b_n(kR)}\right|^2 d\Omega_s \tag{25a}$$

$$= \sum_{l=1}^{L}\sum_{l'=1}^{L'}\sum_{n=0}^{N}\sum_{n'=0}^{N}\sum_{m=-n}^{n}\sum_{m'=-n'}^{n'} D_n^m(\Omega_l)D_{n'}^{m'}(\Omega_{l'})^* \times \left[\frac{\sum_{c=1}^{C}|P_{noise}(\Omega_c, k)|^2 Y_n^m(\Omega_c)^\dagger Y_{n'}^{m'}(\Omega_c)^{\dagger *}}{b_n(kR)b_{n'}(kR)^*}\right]. \tag{26b}$$

For achieving the separation of the noise power weight from the sum of the power of each order n, some restrictions are to be made. That separation can be obtained if the sum over the loudspeakers c can be simplified to equation (10). Therefore the capsule positions have to be nearly equally distributed on the surface of the sphere, so that the condition from equation (9) is satisfied. Furthermore, the power of the noise pressure has to be constant for all capsules. Then the noise power is independent of $\Omega_c$ and can be excluded from the sum over c. Thus, a constant noise power is defined by $$|P_{noise}(k)|^2 = |P_{noise}(\Omega_c, k)|^2 \approx \frac{1}{C^2}\left|\sum_{c=1}^{C} P_{noise}(\Omega_c, k)\right|^2 \tag{26}$$

(24a)

for all capsules. Applying these restrictions, equation (25b) reduces to $$E\{|w_{noise}(k)|^2\} = \frac{4\pi}{C}\sum_{n=0}^{N}\sum_{m=-n}^{n}\frac{\left|\sum_{l=1}^{L} D_n^m(\Omega_l)\right|^2 |P_{noise}(k)|^2}{|b_n(kR)|^2} = \sum_{n=0}^{N} E_n\{|w_{noise}(k)|^2\}. \quad (27)$$

The restriction for the capsule positions is commonly fulfilled for spherical microphone arrays as the array should sample the pressure on the sphere uniformly. A constant noise power can always be assumed for the noise that is produced by the analog processing (e.g. sensor noise or amplification) and the analog-to-digital conversion for each microphone signal. Thus, the restrictions are valid for common spherical microphone arrays.

The expectation value from equation (21b) is a linear superposition of the reference power and the noise power. The power of each weight can be separated to the sum of the power of each order n. Thus the expectation value from equation (21b) can also be separated into a superposition for each order n. This means that the global minimum can be derived from the minimum of each order n so that one optimisation transfer function $F_n(k)$ can be defined for each order n:

$$E\{|w_{ref}(k)|^2\}-2F(k)E\{|w_{ref}(k)|^2\}+F(k)^2(E\{|w_{ref}(k)|^2\}+E\{|w_{noise}(k)|^2\})\geq\Sigma_{n=0}^{N}E_n\{|w_{ref}(k)|^2\}-2F_n(k)E_n\{|w_{ref}(k)|^2\}+F_n(k)^2(E_n\{|w_{ref}(k)|^2\}+E_n\{|w_{noise}(k)|^2\}) \quad (28)$$

The transfer function $F_n(k)$ is obtained from the transfer function F(k) by combining equations (23), (24) and (25). The N+1 optimisation transfer functions are defined by $$F_n(k) = \frac{1}{1+\frac{E_n\{|w_{noise}(k)|^2\}}{E_n\{|w_{ref}(k)|^2\}}} \quad (29a)$$

$$= \frac{1}{1+\frac{(4\pi)^2|P_{noise}(k)|^2}{c|b_n(kR)|^2|P_0(k)|^2}} \quad (29b)$$

$$= \frac{|b_n(kR)|^2}{|b_n(kR)|^2+\frac{(4\pi)^2}{CSNR(k)}}. \quad (29c)$$

The transfer function $F_n(k)$ depends on the number of capsules and the signal to noise ration for the wavenumber k:

$$SNR(k) = \frac{|P_0(k)|^2}{|P_{noise}(k)|^2}. \quad (30)$$

On the other hand the transfer function is independent of the Ambisonics decoder, which means that it is valid for three-dimensional Ambisonics decoding and directional beam forming. Thus the transfer function can also be derived from the mean squared error of the Ambisonics coefficients $d_n^m(k)$ without taking the sum over the decoding coefficients $D_n^m(\Omega_l)$ into account. Because the power $|P_0(k)|^2$ changes over time an adaptive transfer function can be designed from the current SNR(k) of the recorded signal. That transfer function design is further described in section Optimised Ambisonics processing.

A comparison of the transfer function $F_n(k)$ and the Tikhonov regularisation transfer function $$F_{tikhonov} = \frac{|b_n(kR)|^2}{|b_n(kR)|^2+\lambda^2}$$

from section 4, equation (32) in the above-mentioned Moreau/Daniel/Bertet article shows that the regularisation parameter λ can be derived from equation (29c). The corresponding parameter of the Tikhonov regularisation $$\lambda = \frac{(4\pi)}{\sqrt{CSNR(k)}} \quad (31)$$

minimises the average reconstruction error of the Ambisonics recording for a given SNR(k). The transfer functions $F_n(k)$ are shown in FIG. 2*a* to 2*e* for the Ambisonics orders zero to four, respectively, wherein the transfer functions have a highpass characteristic for each order n with increasing cut-off frequency to higher orders. A constant SNR(k) of 20 dB has been used for the transfer function design. The cut-off frequencies decay with the regularisation parameter λ as described in section 4.1.2 in the above-mentioned Moreau/Daniel/Bertet article. Therefore, a high SNR(k) is required to obtain higher order Ambisonics coefficients for low frequencies.

The optimised weight w'(k) is computed from $$w'(k) = \sum_{n=0}^{N}\sum_{m=-n}^{n}\sum_{l=1}^{L} D_n^m(\Omega_l)\times \frac{F_n(k)}{b_n(kR)}\sum_{c=1}^{C} Y_n^m(\Omega_c)^{\dagger}(P_{ref}(\Omega_c, kR)+P_{alias}(\Omega_c kR)+P_{noise}(\Omega_c, k)) = w'_{ref}(k)+w'_{alias}(k)+w'_{noise}(k) \quad (32)$$

Optimised Ambisonics Processing

In the practical implementation of the Ambisonics microphone array processing, the optimised Ambisonics coefficients $d_{n_{opt}}^m(k)$ are obtained from $$d_{n_{opt}}^m(k) = \frac{F_n(k)}{b_n(kR)}\sum_{c=1}^{C} Y_n^m(\Omega_c)^{\dagger} P(\Omega_c, kR), \quad (33)$$

which includes the sum over the capsules c and an adaptive transfer function for each order n and wave number k. That sum converts the sampled pressure distribution on the surface of the sphere to the Ambisonics representation, and for wide-band signals it can be performed in the time domain. This processing step converts the time domain pressure signals $P(\Omega_c, t)$ to the first Ambisonics representation $A_n^m(t)$.

In the second processing step the optimised transfer function $$F_{n,array}(k) = \frac{F_n(k)}{b_n(kR)} \quad (34)$$

reconstructs the directional information items from the first Ambisonics representation $A_n^m(t)$. The reciprocal of the transfer function $b_n(kR)$ converts $A_n^m(t)$ to the directional coefficients $d_n^m(t)$, where it is assumed that the sampled sound field is created by a superposition of plane waves that were scattered on the surface of the sphere. The coefficients $d_n^m(t)$ are representing the plane wave decomposition of the sound field described in section 3, equation (14) of the above-mentioned Rafaely "Plane-wave decomposition . . . " article, and this representation is basically used for the transmission of Ambisonics signals. Dependent on the SNR (k), the optimisation transfer function $F_n(k)$ reduces the contribution of the higher order coefficients in order to remove the HOA coefficients that are covered by noise.

The processing of the coefficients $A_n^m(t)$ can be regarded as a linear filtering operation, where the transfer function of the filter is determined by $F_{n,array}(k)$. This can be performed in the frequency domain as well as in the time domain. The FFT can be used for transforming the coefficients $A_n^m(t)$ to the frequency domain for the successive multiplication by the transfer function $F_{n,array}(k)$. The inverse FFT of the product results in the time domain coefficients $d_n^m(t)$. This transfer function processing is also known as the fast convolution using the overlap-add or over-lap-save method.

Alternatively, the linear filter can be approximated by an FIR filter, whose coefficients can be computed from the transfer function $F_{n,array}(k)$ by transforming it to the time domain with an inverse FFT, performing a circular shift and applying a tapering window to the resulting filter impulse response to smooth the corresponding transfer function. The linear filtering process is then performed in the time domain by a convolution of the time domain coefficients of the transfer function $F_{n,array}(k)$ and the coefficients $A_n^m(t)$ for each combination of n and m.

The inventive adaptive block based Ambisonics processing is depicted in FIG. 3. In the upper signal path, the time domain pressure signals $P(\Omega_c, t)$ of the microphone capsule signals are converted in step or stage 31 to the Ambisonics representation $A_n^m(t)$ using equation (14a), whereby the division by the microphone transfer function $b_n(kR)$ is not carried out (thereby $A_n^m(t)$ is calculated instead of $d_n^m(k)$) and is instead carried out in step/stage 32. Step/stage 32 performs then the described linear filtering operation in the time domain or frequency domain in order to obtain the coefficients $d_n^m(t)$. The second processing path is used for an automatic adaptive filter design of the transfer function $F_{n,array}(k)$. The step/stage 33 performs the estimation of the signal-to-noise ratio SNR(k) for a considered time period (i.e. block of samples). The estimation is performed in the frequency domain for a finite number of discrete wavenumbers k. Thus the regarded pressure signals $P(\Omega_c, t)$ have to be transformed to the frequency domain using for example an FFT. The SNR(k) value is specified by the two power signals $|P_{noise}(k)|^2$ and $|P_0(k)|^2$. The power $|P_{noise}(k)|^2$ of the noise signal is constant for a given array and represents the noise produced by the capsules. The power $|P_0(k)|^2$ of the plane wave has to be estimated from the pressure signals $P(\Omega_c, t)$. The estimation is further described in section SNR estimation. From the estimated SNR(k) the transfer function $F_{n,array}(k)$ with $n \leq N$ is designed in step/stage 34. The filter design comprises the design of the Wiener filter given in equation (29c) and the inverse array response or inverse transfer function $1/b_n(kR)$. Advantageously the Wiener filter limits the high amplification of the transfer function of the inverse array response. This results in manageable amplifications of the transfer function $F_{n,array}(k)$. The filter implementation is then adapted to the corresponding linear filter processing in the time or frequency domain of step/stage 32.

SNR Estimation

The SNR(k) value is to be estimated from the recorded capsules signals: it depends on the average power of the plane wave $|P_0(k)|^2$ and the noise power of the $|P_{noise}(k)|^2$.

The noise power is obtained from equation (26) in a silent environment without any sound sources so that $|P_0(k)|^2=0$ can be assumed. For adjustable microphone amplifiers the noise power should be measured for several amplifier gains. The noise power can then be adapted to the used amplifier gain for several recordings.

The average source power $|P_0(k)|^2$ is estimated from the pressure $P_{mic}(\Omega_c, k)$ measured at the capsules. This is performed by a comparison of the expectation value of the pressure at the capsules from equation (13) and the measured average signal power at the capsules defined by $$E\{|P_{sig}(k)|^2\} = \frac{1}{C^2}\left|\sum_{c=1}^{C} P_{mic}(\Omega_c, k)\right|^2 - |P_{noise}(k)|^2. \tag{35}$$

The noise power $|P_{noise}(k)|^2$ has to be subtracted from the measured power to obtain the expectation value of $P_{sig}(k)$.

The expectation value $P_{sig}(k)$ can also be estimated for the Ambisonics representation of the pressure at the capsules from equation (13) by:

$$E\{|P_{sig}(k)|^2\} = \frac{1}{C^2}E\left\{\left|\sum_{c=1}^{C} P(\Omega_c, kR)\right|^2\right\} \tag{36a}$$

$$= \frac{1}{4\pi C^2}\int_{\Omega_s \in S^2}\left|\sum_{c=1}^{C}\sum_{n=0}^{\infty}\sum_{m=-n}^{n} b_n(kR)Y_n^m(\Omega_c)\right. \tag{36b}$$

$$Y_n^m(\Omega_s)^* P_0(k)|^2 d\Omega_s$$

$$= \frac{|P_0(k)|^2}{4\pi C^2}\sum_{n=0}^{\infty}\sum_{m=-n}^{n}|b_n(kR)|^2 \tag{36c}$$

$$\sum_{c=1}^{C}\sum_{c'=1}^{C} Y_n^m(\Omega_c)Y_n^m(\Omega_{c'})^*.$$

In equation (36b) the orthonormal condition from equation (4) can be applied to the expansion of the absolute magnitude to derive equation (36c). Thereby the average signal power is estimated from the cross-correlation of the spherical harmonics $Y_n^m(\Omega_c)$. In combination with the transfer function $b_n(kR)$ this represents the coherence of the pressure field at the capsule positions. The equalisation of equations (35) and (36) obtains the estimation of $|P_0(k)|^2$ from the recorded pressure signals $P_{mic}(\Omega_c, k)$ and the estimated noise power $|P_{noise}(k)|^2$, which is presented in equation (37):

$$|P_0(k)|^2 = \frac{\left|\sum_{c=1}^{C} P_{mic}(\Omega_c, k)\right|^2 - C^2|P_{noise}(k)|^2}{\frac{1}{4\pi}\sum_{n=0}^{\infty}\sum_{m=-n}^{n}|b_n(kR)|^2\sum_{c=1}^{C}\sum_{c'=1}^{C} Y_n^m(\Omega_c)Y_n^m(\Omega_{c'})}. \tag{37}$$

The denominator from equation (37) is constant for each wave number k for a given microphone array. It can therefore be computed once for the Ambisonics order $N_{max}$ to be stored in a look-up table or store for each wave number k.

Finally, the SNR(k) value is obtained from the capsule signals $P(\Omega_c c, kR)$ by $$SNR(k) = \frac{\left|\sum_{c=1}^{C} P_{mic}(\Omega_c, k)\right|^2 - \left|\sum_{c=1}^{C} P_{noise}(\Omega_c, k)\right|^2}{\frac{1}{4\pi C^2}\left|\sum_{c=1}^{C} P_{noise}(\Omega_c, k)\right|^2 \sum_{n=0}^{\infty}\sum_{m=-n}^{n} |b_n(kR)|^2 \sum_{c=1}^{C}\sum_{c'=1}^{C} Y_n^m(\Omega_c) Y_n^m(\Omega_{c'})}. \quad (38)$$

The estimation of the average source power from the given capsule signals is also known from the linear microphone array processing. The cross-correlation of the capsule signal is called the spatial coherence of the sound field. For linear array processing the spatial coherence is determined from the continuous representation of the plane wave. The description of the scattered sound field on a rigid sphere is known only in the Ambisonics representation. Therefore, the presented estimation of the SNR(k) is based on a new processing that determines the spatial coherence on the surface of a rigid sphere.

As a result, the average power components of w'(k) obtained from the optimisation filter of FIG. 2 are shown in FIG. 4 for a mode matching Ambisonics decoder. The noise power is reduced to −35 dB up to a frequency of 1 kHz. Above 1 kHz the noise power increases linearly to −10 dB. The resulting noise power is smaller than $P_{noise}(\Omega_c, k)=-20$ dB up to a frequency of about 8 kHz. The total power is raised by 10 dB above 10 kHz, which is caused by the aliasing power. Above 10 kHz the HOA order of the microphone array does not sufficiently describe the pressure distribution on the surface for a sphere with a radius equal to R. Thus, the average power caused by the obtained Ambisonics coefficients is greater than the reference power.

The invention claimed is:

1. A method for processing microphone capsule signals of a spherical microphone array on a rigid sphere, said method comprising:

sampling by the spherical microphone array microphone capsule signals representing the pressure on the surface of said microphone array;

converting said microphone capsule signals to a spherical harmonics or Ambisonics representation $A_n^m(t)$;

computing per wave number k an estimation of the time-variant signal-to-noise ratio SNR (k) of said microphone capsule signals; multiplying a transfer function of a time-variant Wiener filter by an inverse transfer function of said microphone array in order to get an adapted transfer function $F_{n,array}(k)$;

applying said adapted transfer function $F_{n,array}(k)$ to said spherical harmonics or Ambisonics representation $A_n^m(t)$ using a linear filter processing, resulting in adapted directional time domain coefficients $d_n^m(t)$, wherein n denotes the Ambisonics order and index n runs from 0 to a finite order and m denotes the degree and index m runs from −n to n for each index n, wherein the spherical microphone array includes microphones separated based on a distribution on a surface of a sphere.

2. The method of claim 1, wherein the spherical harmonics are determined based on the distribution on the surface of the sphere, wherein the distribution is based on:

$$\delta_{n-n'}\delta_{m-m'} = \frac{4\pi}{C}\sum_{c=1}^{C} w_c Y_n^m(\Omega_c) Y_{n'}^{m'}(\Omega_c)^*,$$

wherein $\Omega_c$ are optimal sampling points, $$\text{where } \delta_q = \begin{cases} 1, & \text{for } q = 0 \\ 0, & \text{else} \end{cases} \text{ is the delta impulse}$$

$n' \le N$ and $n \le N$ for $C \ge (N+1)^2$, C is a total number of capsules, and $w_c$ is a set of weights to enable orthonormality of the sampled spherical harmonics, and N is an Ambisonics order.

3. The method of claim 2, wherein the conjugated complex spherical harmonics are replaced by the columns of a pseudo-inverse matrix $Y^\dagger$, which is obtained from the L×O spherical harmonics matrix Y, where O coefficients of the spherical harmonics $Y_n^m(\Omega_c)$ are the row-elements of Y, based on:

$$Y^\dagger = (Y^H W Y)^{-1} Y^H W$$

wherein W is an additional weighting matrix to account for the non-uniformity of the microphone distribution.

4. The method of claim 1, wherein the spherical harmonics are determined based on the distribution on the surface of the sphere, wherein the distribution is based on spherical sampling points that are based upon hyper-interpolation from a well-conditioned matrix Y such that:

$$\delta_{n-n'}\delta_{m-m'} = \sum_{c=1}^{C} Y_n^m(\Omega_c)\, Y_{n'}^{m'}(\Omega_c)^{-1}$$

wherein $Y_{n'}^{m'}(\Omega_c)^{-1}$ are the columns of $Y^{-1}$, and wherein $c=(N+1)^2$ $\Omega_c$ are optimal sampling points, and N is an Ambisonics order.

5. An apparatus for processing microphone capsule signals of a spherical microphone array on a rigid sphere, said apparatus including:

a spherical microphone array configured for sampling microphone capsule signals representing the pressure on the surface of said microphone array;

means for converting the microphone capsule signals to a spherical harmonics or Ambisonics representation $A_n^m(t)$;

means for computing per wave number k an estimation of the time-variant signal-to-noise ratio SNR(k) of said microphone capsule signals;

means for multiplying a transfer function of said of a time-variant Wiener filter by an inverse transfer function of said microphone array in order to get an adapted transfer function $F_{n,array}(k)$;

means for applying said adapted transfer function $F_{n,array}(k)$ to said spherical harmonics or Ambisonics representation $A_n^m(t)$ using a linear filter processing, resulting in adapted directional coefficients $d_n^m(t)$, wherein n denotes the Ambisonics order and index n runs from 0 to a finite order and m denotes the degree and index m runs from −n to n for each index n, wherein the spherical microphone array includes microphones separated based on a distribution on a surface of a sphere.

6. The apparatus of claim 5, wherein the spherical harmonics are determined based on the distribution on the surface of the sphere, wherein the distribution is based on:

$$\delta_{n-n'}\delta_{m-m'} = \frac{4\pi}{C}\sum_{c=1}^{C} w_c Y_n^m(\Omega_c) Y_{n'}^{m'}(\Omega_c)^*,$$

wherein $\Omega_c$ are optimal sampling points, $$\text{where } \delta_q = \begin{cases} 1, & \text{for } q = 0 \\ 0, & \text{else} \end{cases} \text{ is the delta impulse}$$

$n' \leq N$ and $n \leq N$ for $C \geq (N+1)^2$, C is a total number of capsules, and $w_c$ is a set of weights to enable orthonormality of the sampled spherical harmonics, and N is an Ambisonics order.

7. The apparatus of claim 6, wherein the conjugated complex spherical harmonics are replaced by the columns of a pseudo-inverse matrix $Y^\dagger$, which is obtained from the L×O spherical harmonics matrix Y, where O coefficients of the spherical harmonics $Y_n^m(\Omega_c)$ are the row-elements of Y, based on:

$$Y^\dagger = (Y^H W Y)^{-1} Y^H W$$

wherein W is an additional weighting matrix to account for the non-uniformity of the microphone distribution.

8. The apparatus of claim 5, wherein the spherical harmonics are determined based on the distribution on the surface of the sphere, wherein the distribution is based on spherical sampling points that are based upon hyper-interpolation that form a well-conditioned matrix Y such that:

$$\delta_{n-n'}\delta_{m-m'} = \sum_{c=1}^{C} Y_n^m(\Omega_c)\, Y_{n'}^{m'}(\Omega_c)^{-1}$$

wherein $Y_{n'}^{m'}(\Omega_c)^{-1}$ are the columns of $Y^{-1}$, and wherein $c=(N+1)^2$ $\Omega_c$ are optimal sampling points, and N is an Ambisonics order.

* * * * *